US010893994B2

(12) United States Patent
Song

(10) Patent No.: US 10,893,994 B2
(45) Date of Patent: Jan. 19, 2021

(54) APPARATUS FOR ASSISTING TOILET USER IN STANDING UP

(71) Applicant: Soon Young Song, Anyang-si (KR)

(72) Inventor: Soon Young Song, Anyang-si (KR)

( * ) Notice: Subject to any disclaimer, the term of this patent is extended or adjusted under 35 U.S.C. 154(b) by 163 days.

(21) Appl. No.: 16/282,319

(22) Filed: Feb. 22, 2019

(65) Prior Publication Data

US 2020/0008992 A1 Jan. 9, 2020

(30) Foreign Application Priority Data

Jul. 9, 2018 (KR) ..... 10-2018-0079126

(51) Int. Cl.
*A61G 7/10* (2006.01)
*A47K 13/10* (2006.01)

(52) U.S. Cl.
CPC ..... *A61G 7/1007* (2013.01); *A47K 13/105* (2013.01); *A61G 7/1094* (2013.01)

(58) Field of Classification Search
CPC .... A47K 13/10; A47K 13/105; A47K 17/026; A61G 5/14; A61G 7/1007
USPC ..... 297/330
See application file for complete search history.

(56) References Cited

U.S. PATENT DOCUMENTS 1,505,472 A * 8/1924 Shichigoro ..... A47K 13/10 4/246.5
3,343,871 A * 9/1967 Yates ..... A61G 5/14 297/323
3,404,411 A * 10/1968 Newkirk ..... A47K 13/10 4/246.1
3,474,471 A * 10/1969 Matibag ..... A47K 17/026 4/254
4,894,871 A * 1/1990 Schmerler ..... A47K 17/026 135/67
2016/0143795 A1* 5/2016 Schwartz ..... A61G 5/14 5/83.1

FOREIGN PATENT DOCUMENTS

JP 3785233 * 6/2006 ..... A47K 17/026
JP 4434923 * 3/2010 ..... A47K 17/026
JP 2013023376 * 2/2013 ..... A47K 13/10
KR 20-0232669 Y1 10/2001

* cited by examiner

*Primary Examiner* — David P Angwin
*Assistant Examiner* — Nicholas A Ros
(74) *Attorney, Agent, or Firm* — Revolution IP, PLLC

(57) ABSTRACT

An apparatus for aiding a user of a toilet in standing up includes a structure where the user can sit, and includes a movable seat movably mounted to the toilet; and a seat actuator arranged adjacent to the toilet and actuating the movable seat to move having at least one of lifting movement and pivoting movement.

1 Claim, 13 Drawing Sheets

APPARATUS FOR ASSISTING TOILET USER IN STANDING UP

CROSS-REFERENCE TO RELATED APPLICATION

This application claims priority from Korean Patent Application No. 10-2018-0079126, filed on Jul. 9, 2018 in the Korean Intellectual Property Office, the disclosure of which is incorporated herein by reference.

BACKGROUND OF THE INVENTION

(a) Field of the Invention

The disclosure relates to an apparatus for aiding a toilet user in standing up, and more particularly to an apparatus for aiding a toilet user in standing up, in which a movable seat where the toilet user sits is automatically movable having at least one of lifting movement and pivoting movement, thereby assisting the toilet user in easily and safely standing up.

(b) Description of the Related Art

In general, a toilet includes a main body installed on a floor and having a moderate height so that a user can sit to relieve himself/herself, and a seat provided on the top of the main body and hinged at the back to be lifted up as necessary.

Such a toilet is comfortable to sit down and relieve nature, but makes various sick people, elderly or weak people, and disabled people, whose legs are weak, feel much difficulty in standing up from a seating position after easing nature.

To make up for such shortcomings, an auxiliary sidebar has been conventionally installed around a toilet so that the sick people, elderly or weak people, and disabled people can sit down or stand up grabbing the side bar. However, most of them whose legs are weak are also weak in arms and therefore have a problem of difficulty in leaning on the side bar.

To solve this problem, Korean Utility Model No. 20-0232669 (hereinafter, referred to as the "related art") has proposed a toilet seat for the elderly, the weak and the lower-body disabled so that the disabled, the elderly, the weak and the like lower-body handicapped people can easily stand up from a sitting position without effort after relieving nature.

The toilet seat of the related art has an advantage of assisting the elderly, the weak and the like people in standing up easily, but is useless for the elderly, the weak and the disabled who cannot operate it with their own strength because the toilet seat employs a structure of being operated by the strength of the elderly, the weak and the like people. Also, the toilet seat of the related art has a disadvantage of resulting in considerably high possibility of unexpected severe accidents while the elderly, the weak and the disabled operate it with their own strength.

Further, to assist the elderly, the weak and the like people in easily and safely standing up, not only lifting movement for vertically moving the seat up and down but also pivoting movement to be used in combination with the lifting movement is required. However, such combination of the lifting movement and the pivoting movement makes a structure complicated and big. Accordingly, there is a need of a standing aid having a simple and small structure.

SUMMARY OF THE INVENTION

Accordingly, the disclosure is conceived to solve the foregoing problems, and an aspect of the disclosure is to provide an apparatus for aiding a toilet user in standing up, in which a movable seat where the toilet user sits is automatically movable having at least one of lifting movement and pivoting movement, thereby assisting the toilet user in easily and safely standing up.

In accordance with an embodiment of the present disclosure, there is provided an apparatus for aiding a user of a toilet in standing up, which has a structure where the user can sit, and includes a movable seat movably mounted to the toilet; and a seat actuator arranged adjacent to the toilet and actuating the movable seat to move having at least one of lifting movement and pivoting movement, the seat actuator including: a mounting frame adjacent to and stationarily mounted to the toilet; a link assembly movably mounted to the mounting frame, including at least two links which receive a driving force through a first end and produce the lifting movement and the pivoting movement of the movable seat connected to a second end; and a driving assembly mounted to the mounting frame and transmitting the driving force to the first end of the link assembly, the mounting frame including: an operating route guide hole corresponding to a hole having a certain path for determining and guiding the movement mode of the movable seat and a production route of the movement mode; a first guide hole configured to guide movement of a first pivot joint of the link assembly; and a second guide hole configured to guide movement of a support guide pin of the link assembly, the link assembly including: a moving link, a connection link, and an actuating link, in which the moving link and the connection link are pivotably connected by the first pivot joint, and the connection link and the actuating link are pivotably connected by a second pivot joint, and the second pivot joint being arranged to be inserted in the operating route guide hole, and the actuating link being provided with the support guide pin arranged to be inserted in the second guide hole.

The apparatus for aiding a user of a toilet in standing up may further include a mobility-assistance safety bar arranged adjacent to the toilet, wherein the mobility-assistance safety bar includes a first connection bar; a second connection bar angle-adjustably connected to the first connection bar; a connection module connecting a first end of the first connection bar and a first end of the second connection bar so that an angle between the first connection bar and the second connection bar is adjustable; and a pair of coupling/suction modules coupled to a second end of at least one of the first connection bar and the second connection bar, adjustable in angle with respect to the coupled connection bar, and stuck to a target surface by a suction force.

BRIEF DESCRIPTION OF THE DRAWINGS

The above and/or other aspects of the disclosure will become apparent and more readily appreciated from the following description of the exemplary embodiments, taken in conjunction with the accompanying drawings, in which.

DETAILED DESCRIPTION

Below, embodiments of an apparatus for aiding a toilet user in standing up according to the disclosure with the foregoing objects, solutions, and effects will be described in detail with reference to the accompanying drawings.

Figure 1:
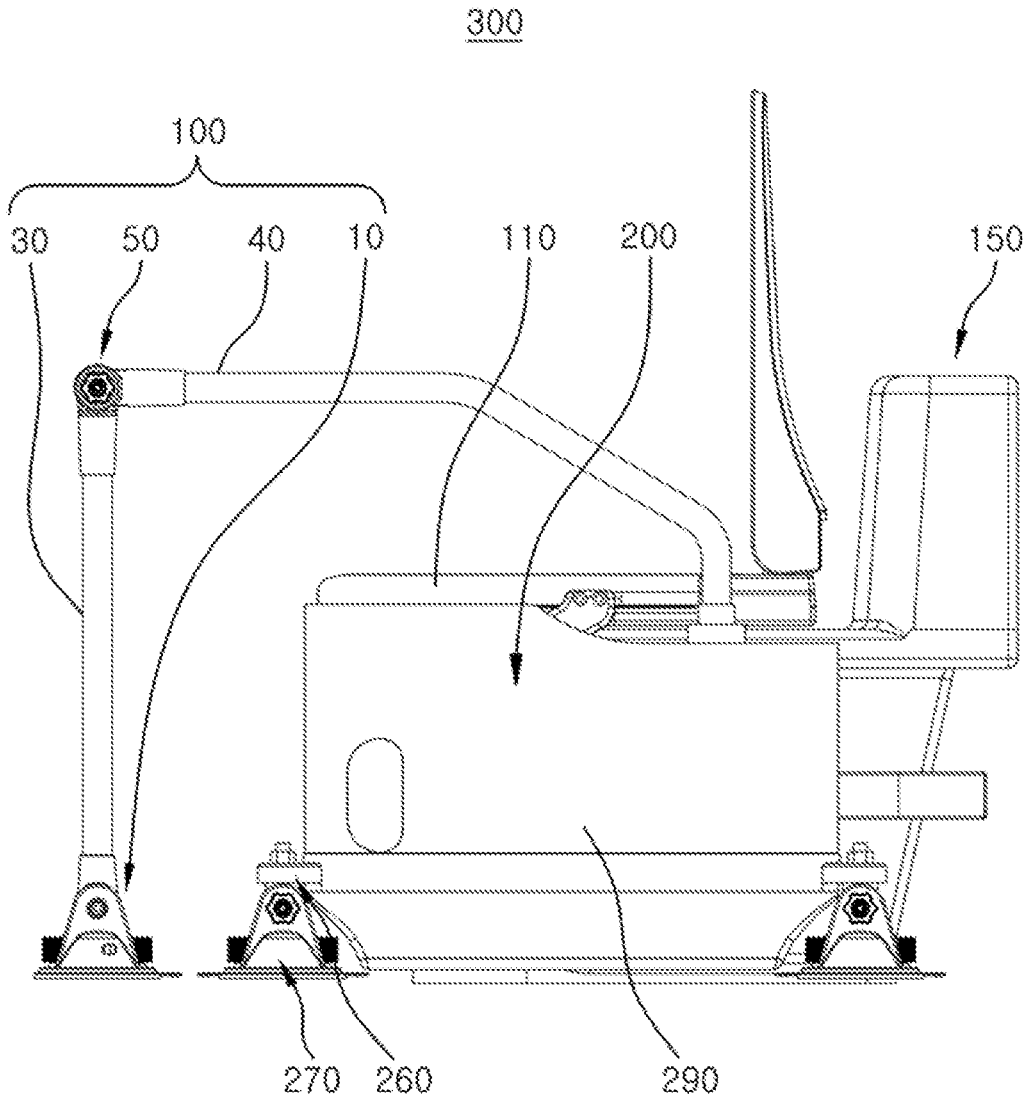
FIG. 1 is a lateral view of an apparatus for aiding a toilet user in standing up according to an embodiment of the disclosure.
Figure 2:
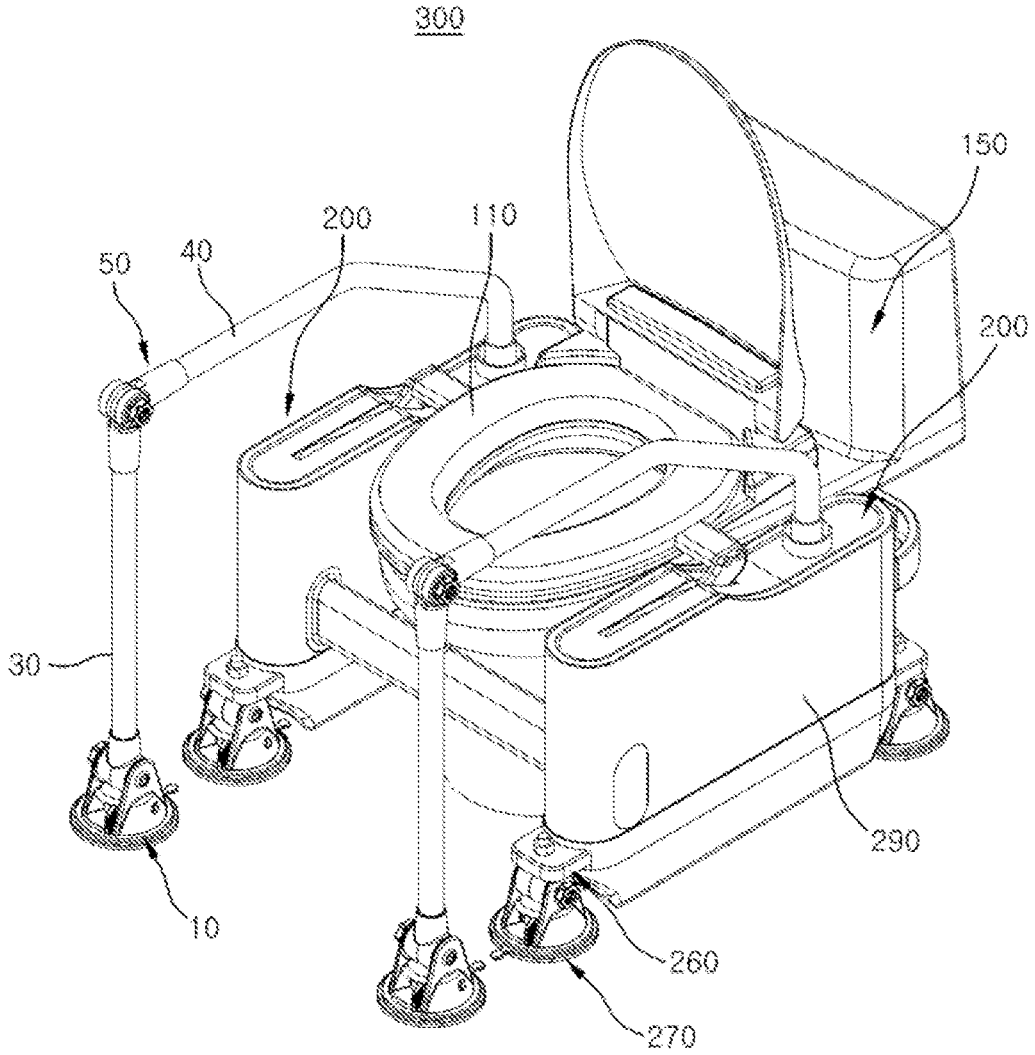
FIG. 2 is a perspective view.
Figure 3:
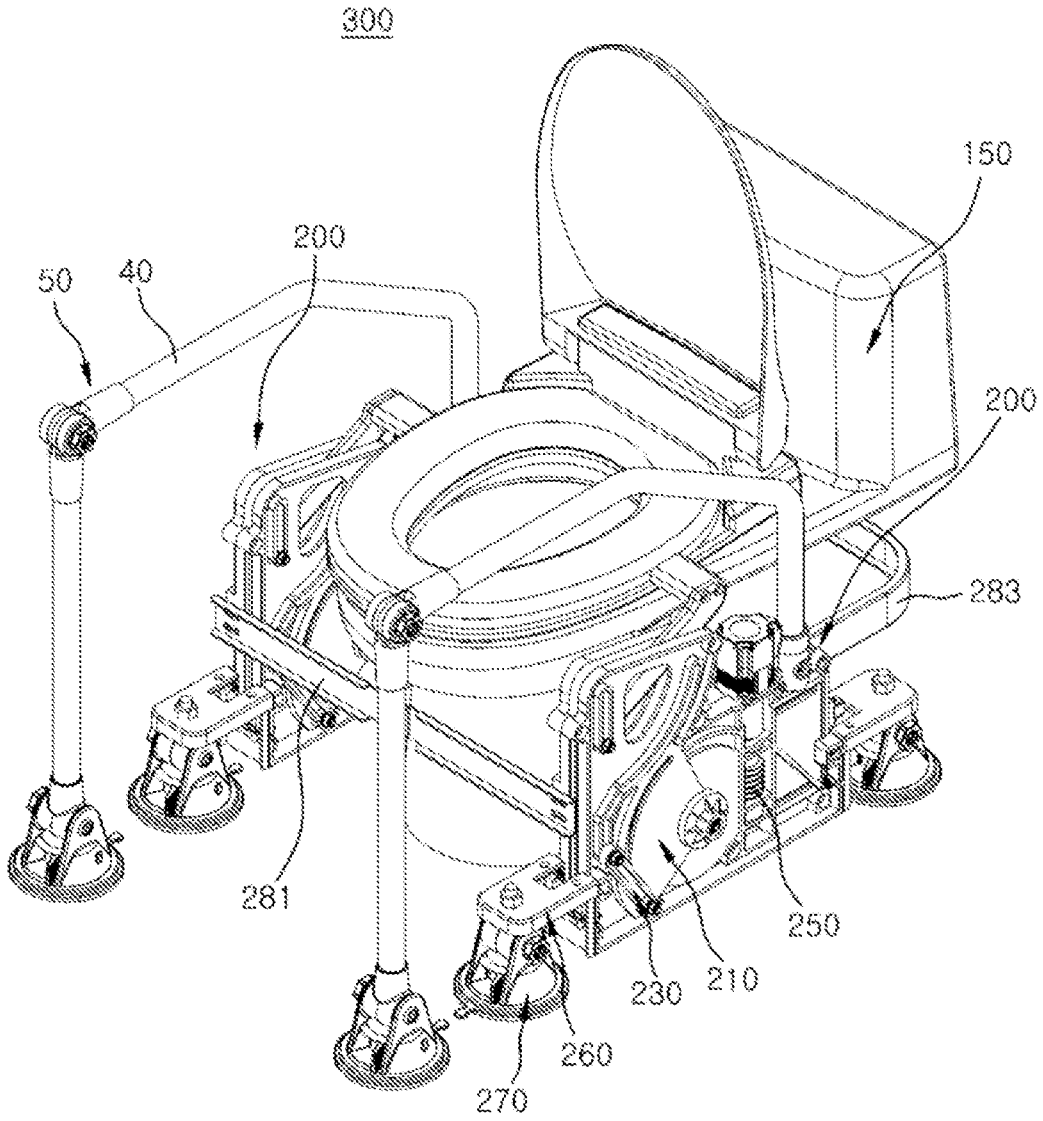
FIG. 3 is a first partially disassembled perspective view.
Figure 4:
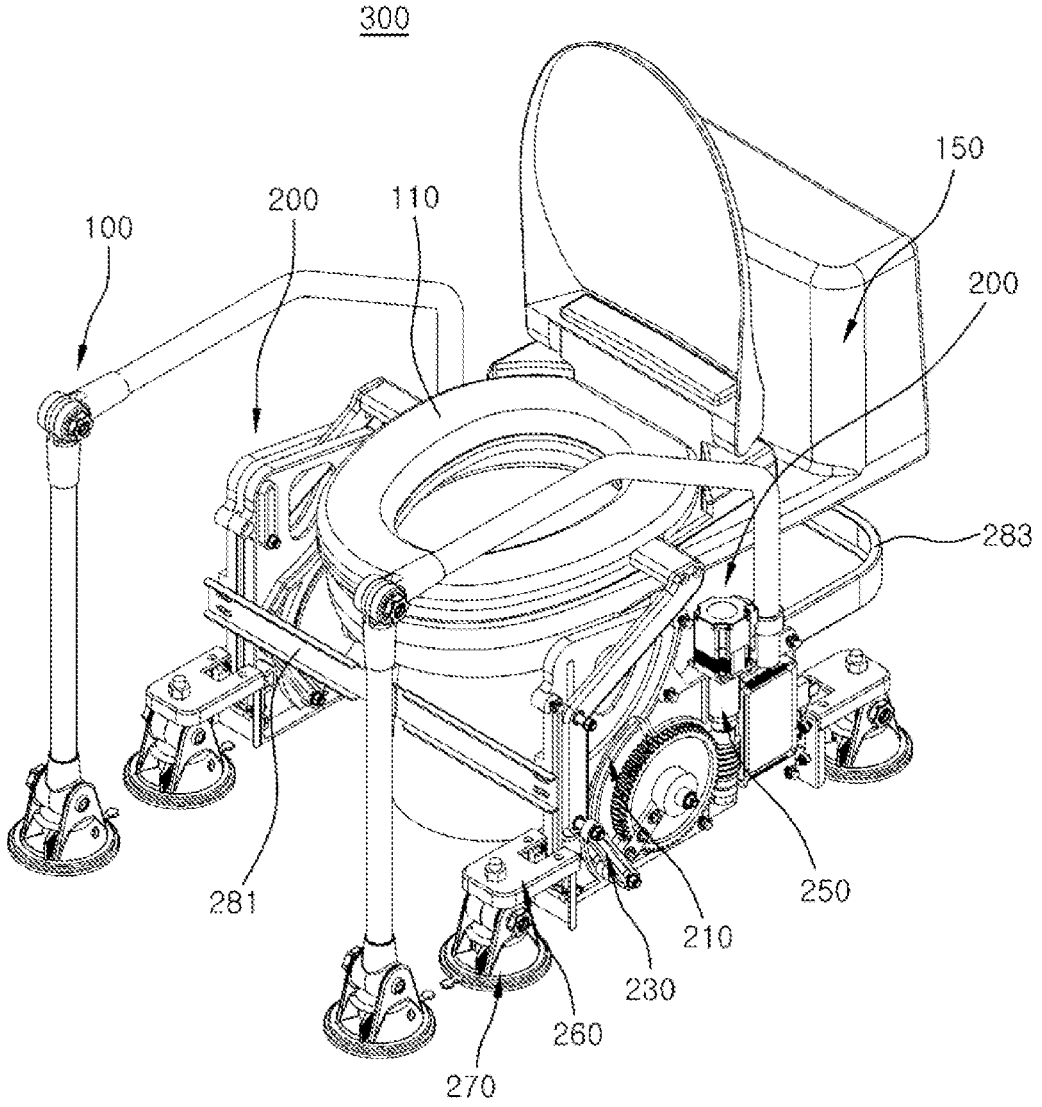
FIG. 4 is a second partially disassembled perspective view.
Figure 5:
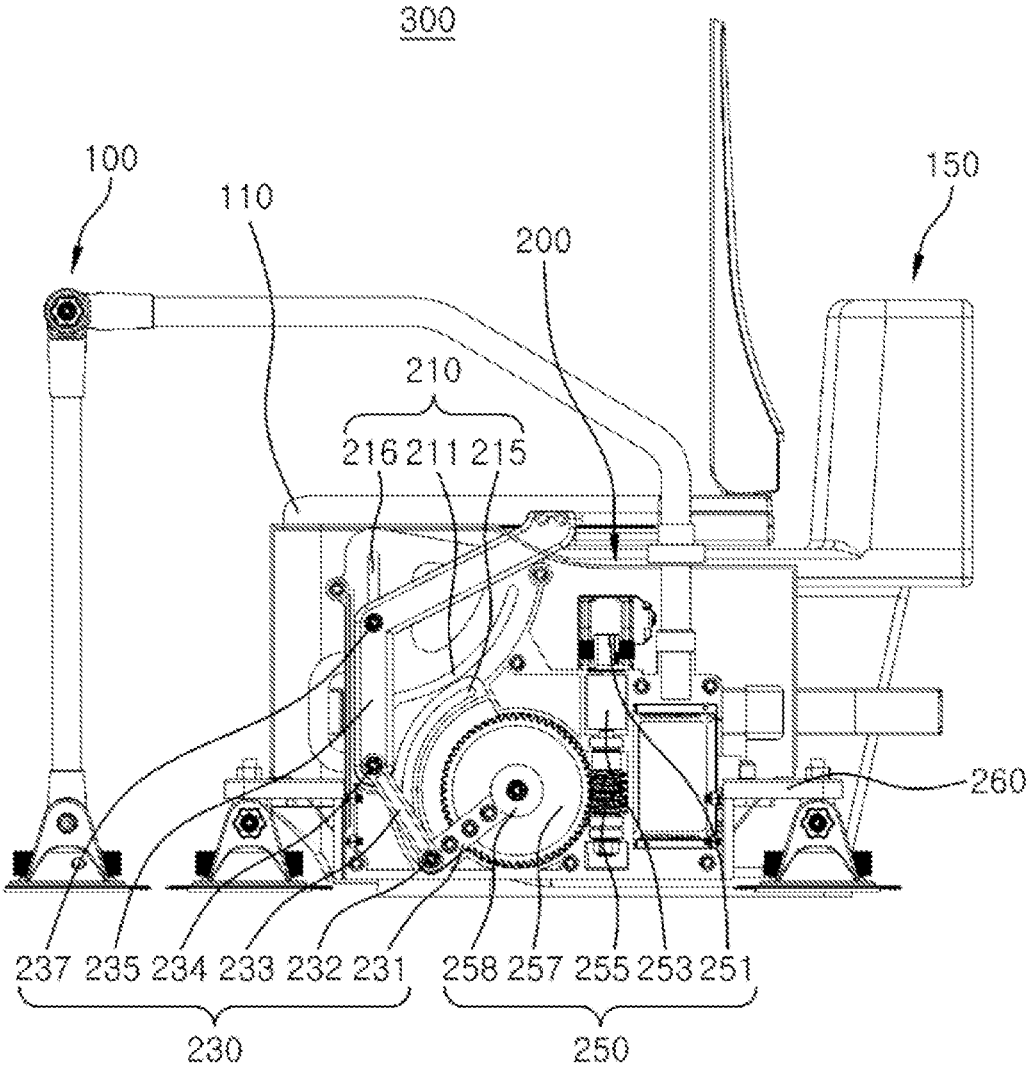
FIG. 5 is a lateral view of FIG. 4.
Figure 6:
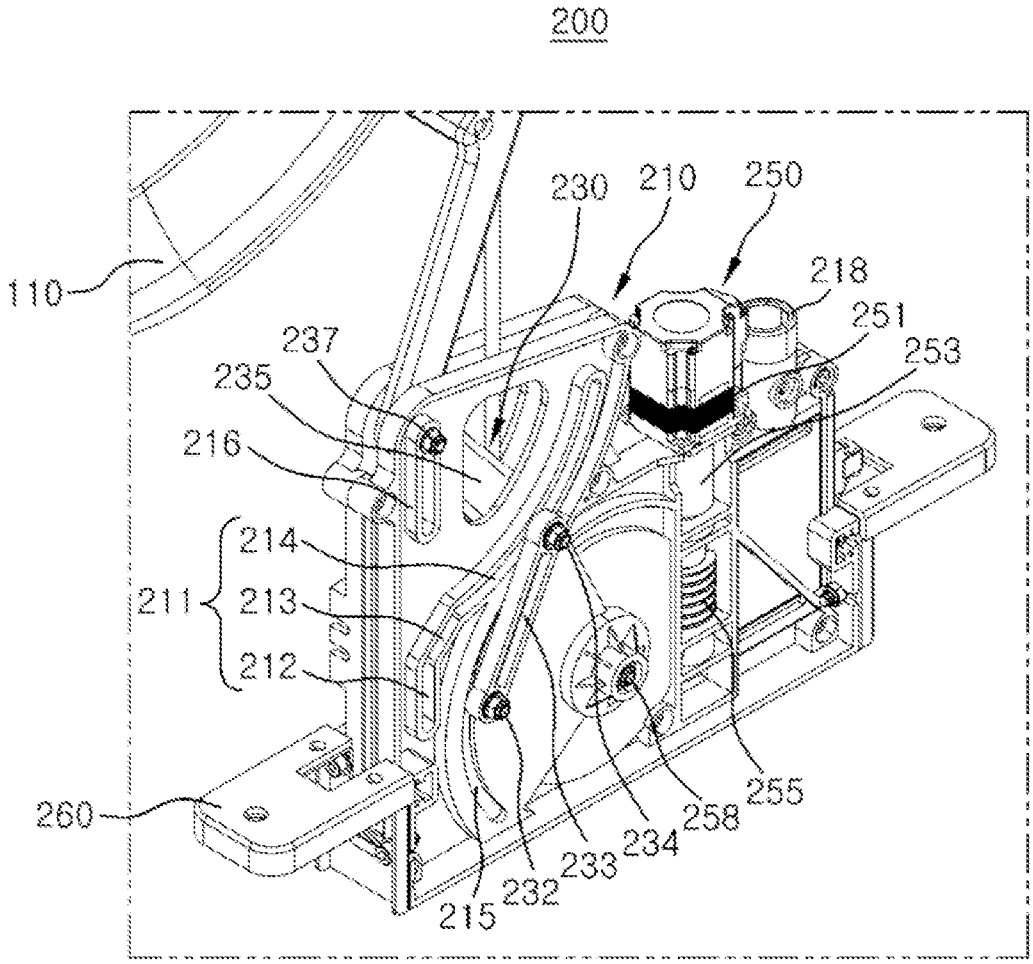
FIG. 6 is an enlarged perspective view of an apparatus for aiding a toilet user in standing up according to an embodiment of the disclosure.
Figure 7:
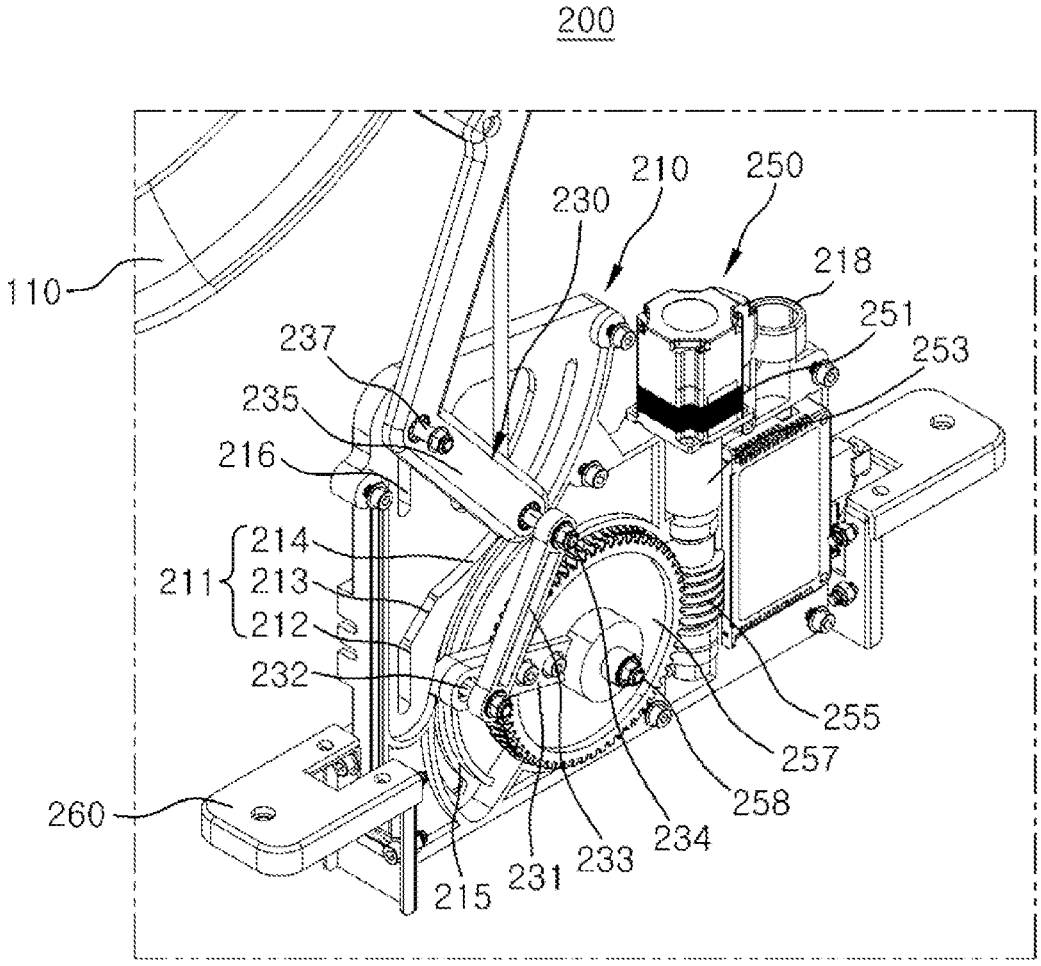
FIG. 7 is a partially disassembled enlarged perspective view.
Figure 8:
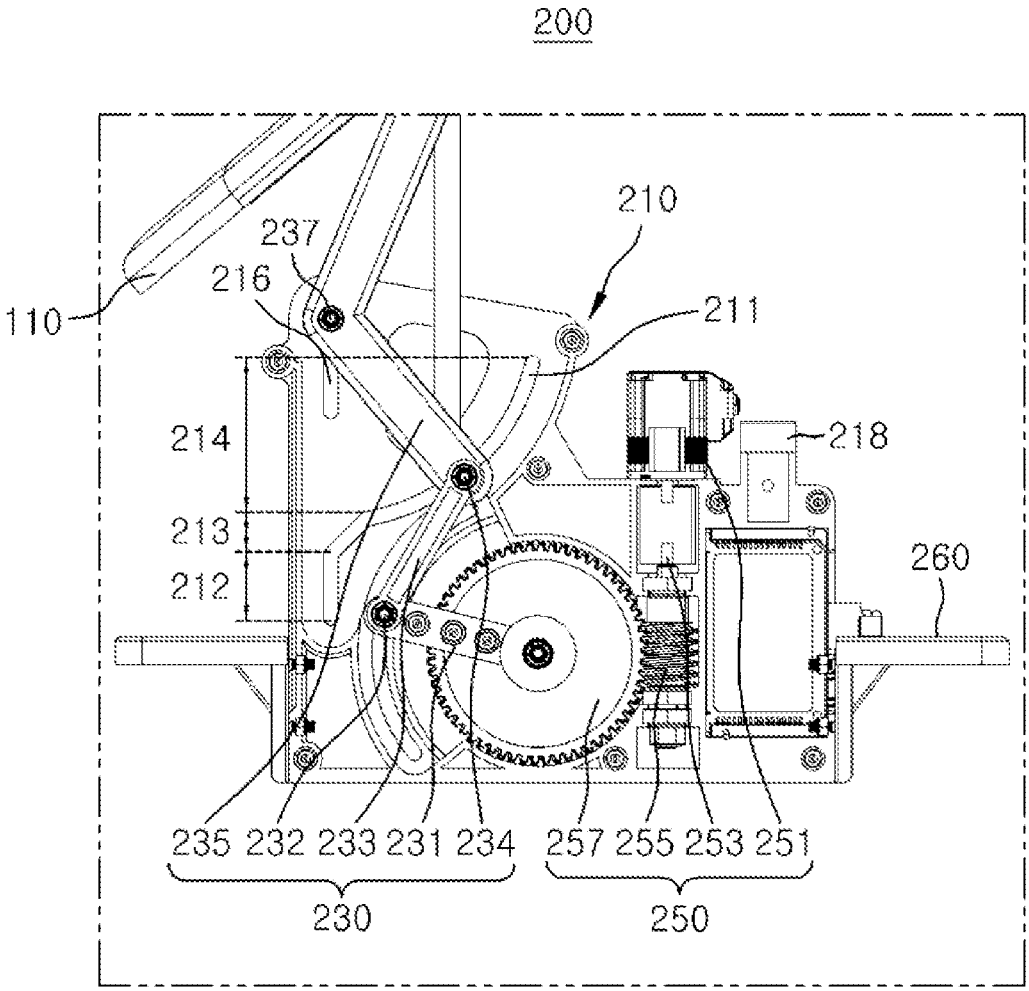
FIG. 8 is an enlarged lateral view.

FIG. 1 is a lateral view of an apparatus for aiding a toilet user in standing up according to an embodiment of the disclosure, FIG. 2 is a perspective view, FIG. 3 is a first partially disassembled perspective view (from which a case 290 is removed), FIG. 4 is a second partially disassembled perspective view (from which one part of a mounting frame is removed), and FIG. 5 is a lateral view of FIG. 4. Further, FIG. 6 is an enlarged perspective view of an apparatus for aiding a toilet user in standing up according to an embodiment of the disclosure, FIG. 7 is a partially disassembled enlarged perspective view (from which one part of a mounting frame is removed), and FIG. 8 is an enlarged lateral view.

As shown in FIGS. 1 to 8, an apparatus 300 for aiding a toilet user in standing up according to an embodiment of the disclosure includes a movable seat 110 having a structure allowing a user of a toilet 150 to sit thereon, and a seat actuator 200 adjacent to the toilet 150 and controlling movement of the movable seat 110.

The movable seat 110 is movably mounted to the toilet 150. In other words, the movable seat 110 has a structure on which a user of the toilet 150 sits, and is movably mounted to the toilet 150. The movable seat 110 may be a general seat bundled with the toilet 150, or a special seat provided separately from the general seat bundled with the toilet 150.

The movable seat 110 has a structure that a user of the toilet 150 can sit on. Further, the movable seat 110 may be configured for direct contact with hips of a toilet user, or may be configured to indirectly contact and support the hips of the user with an additional medium (or a separate seat, etc.) interposed between the movable seat 110 and the hips.

The movable seat 110 is not immovably but movably mounted to the toilet 150, and therefore fastened to the seat actuator 200 as put on the rim of the toilet 150. In other words, the movable seat 110 is mounted onto the rim of the toilet 150 as fastened to the seat actuator 200, and thus kept movable corresponding to operations of the seat actuator 200.

The movement of the movable seat 110 is driven by the seat actuator 200. That is, the movable seat 110 has lifting movement and/or pivoting movement according to the operations of the seat actuator 200 so that a user of the toilet 150 can stand up, i.e. rise from the movable seat 110. The seat actuator 200 operates to make the movable seat 110 have either the lifting movement or the pivoting movement or have both the lifting movement and the pivoting movement.

Thus, the seat actuator 200 according to the disclosure is adjacent to the toilet 150 and controls the movement of the movable seat 110 so that the movable seat 110 can have at least one of the lifting movement and the pivoting movement.

The seat actuator 200 needs to have a structure to be conveniently and easily installed without spoiling an outer appearance since it is provided adjacent to the toilet 150 and makes the movable seat 110 move, i.e. have at least one movement between the lifting movement corresponding to vertical reciprocation and the pivoting movement corresponding to rotation.

Like this, the seat actuator 200 is required to have an easy and simple structure to be disposed adjacent to the toilet 150 and a structure for arrangement and miniaturization to occupy a minimum installation space. To this end, the seat actuator 200 may have various structures. The seat actuator 200 according to the disclosure employs a structure to be simply and easily installed at a side of the toilet 150 while occupying the minimum installation space.

As shown in FIGS. 4 to 8, the seat actuator 200 according to the disclosure includes a mounting frame 210 shaped like a plate, a link assembly 230 movably mounted to the mounting frame 210 and making the movement of the movable seat 110, and a driving assembly 250 generating and transmitting a driving force to cause the link assembly 230 to make the movement of the movable seat 110.

Basically, the mounting frame 210 is fixed and mounted adjacent to the toilet 150 so that the link assembly 230 and the driving assembly 250 mounted thereto can operate. Specifically, the mounting frame 210 is stably and firmly mounted to a side portion of the toilet 150. Although it will be described later, the mounting frame 210 is stably supported on a floor by a support/suction module 270 with a support bracket 260 and thus strongly and stably arranged at a lateral portion of the toilet 150.

The mounting frame 210 includes a first mounting frame and a second mounting frame, of which structures are similar to each other. The first mounting frame and the second mounting frame are assembled facing with each other into the mounting frame 210. The link assembly 230 and the driving assembly 250 have to be kept mounted or arranged between the first mounting frame and the second mounting frame. To this end, the first mounting frame and the second mounting frame are coupled facing with each other to accommodate, mount or arrange the link assembly 230 and the driving assembly 250.

The mounting frame 210 is configured to guide the link assembly 230 to stably make the lifting movement and the pivoting movement of the movable seat 110. To this end, the mounting frame 210 is formed with an operating route guide hole 211, a first guide hole 215, and a second guide hole 216.

Specifically, the operating route guide hole 211 refers to a hole having a certain path for determining and guiding the movement mode of the movable seat 110 (i.e. either of vertical lifting movement or pivoting movement or both the lifting movement and the pivoting movement) and a production route of the movement mode. Further, the first guide hole 215 is configured to guide movement of a first pivot joint 232 of the link assembly 230 to be described later, and the second guide hole 216 is configured to guide movement of a support guide pin 237 of the link assembly 230 (to be described later) and at the same time assist the movable seat 110 with smooth movement. In this regard, more detailed descriptions will be made later.

The link assembly 230 is movably mounted to the mounting frame 210 and includes at least two links to receive a driving force at a first end thereof and make the lifting movement and the pivoting movement of the movable seat 110 connected to a second end thereof.

Like this, the link assembly 230 receives the driving force from the driving assembly 250 and operates to make the lifting movement and the pivoting movement of the movable seat 110. On the contrary to a conventional structure where only the lifting movement or only the pivoting movement is made to operate the seat, the movable seat 110 according to the disclosure has an operating structure based on both the lifting movement corresponding to the vertical movement and the pivoting movement corresponding to rotation with respect to a specific point. Such an operation is actualized by the link assembly 230 employed in the disclosure.

Since the link assembly 230 receives the driving force from the driving assembly 250 and makes the movable seat 110 operate through the lifting movement and the pivoting movement, the movable seat 110 can more stably and easily aid a sitting toilet user in standing up.

The link assembly 230 includes at least two links which are coupled to make the movable seat 110 have not only the lifting movement but also the pivoting movement. In other words, at least two links are assembled into the link assembly 250 that operates to produce the lifting movement and the pivoting movement of the movable seat 110.

Since the link assembly 230 receives the driving force from the driving assembly 250 and operates to produce the lifting movement and the pivoting movement of the movable seat 110, the link assembly 230 includes the first end connected to the driving assembly 250 and receiving the driving force, and the second end connected to the movable seat 110 and making the movable seat 110 have the lifting movement and the pivoting movement.

To transmit the driving force to the link assembly 230, the driving assembly 250 is mounted to the mounting frame 210 and arranged to transmit the driving force to the first end of the link assembly 230. The driving assembly 250 is provided to transmit the driving force to the first end of the link assembly 230 (i.e. transmit rotatory force to a moving link 231, which will be described later), and is configured to have a convenient and simple structure, in particular, a structure for not only occupying the minimum installation space but also miniaturization. In this regard, detailed descriptions will be made later.

As described above, the link assembly 230 includes at least two links and operates to make the movable seat 110 have the lifting movement and the pivoting movement. When two links are pivotably coupled and assembled into the link assembly 230, it is possible to produce the lifting movement and the pivoting movement of the movable seat 110 connected to the second end of the link assembly 230. However, in this case, the link assembly 230 needs to have a structure for applying the driving force for translation motion at a lower portion of the first end. In result, there is a need of a structure where the driving assembly 250 for transmitting the driving force to the first end of the link assembly 230 is mounted to and arranged at the lower portion of the link assembly 230. However, such a structure causes a problem of increasing the height of the seat actuator 200. The seat actuator 200 has to be installed not to be higher than the height of the toilet 150.

To solve this problem, the link assembly 230 according to the disclosure is configured with three links, i.e. the moving link 231, a connection link 233 and an actuating link 235. Like this, the link assembly 230 includes three links, and therefore the driving assembly 250 is arranged at not the lower portion but a lateral portion of the link assembly 230, thereby transmitting the driving force to the link assembly 230, in particular, the rotatory force to the moving link 231.

The moving link 231 and the connection link 233 of the link assembly 230 are connected by the first pivot joint 232 and pivotable with respect to each other, and the connection link 233 and the actuating link 235 are connected by a second pivot joint 234 and pivotable with respect to each other.

Specifically, the moving link 231 has a first end connected to the driving assembly 250, i.e. a pivoting shaft 258 of a worm wheel 257, and a second end pivotably connected to the connection link 233 by the first pivot joint 232. Further, the connection link 233 has a first end pivotably connected to the second end of the moving link 231 by the first pivot joint 232, and a second end pivotably connected to the actuating link 235 by the second pivot joint 234. Further, the actuating link 235 has a first end pivotably connected to the second end of the connection link 233 by the second pivot joint 234, and a second end connected to the movable seat 110.

The moving link 231 receives the rotatory force from the driving assembly 250 arranged at the lateral portion of the link assembly 230. The rotatory force is transmitted to the first end of the connection link 233 so that the connection link 233 can move in up and down directions. In result, the actuating link 235 connected to the connection link 233 also moves in the up and down directions.

With the foregoing configuration, the link assembly 230 makes the movable seat 110 operate having the lifting movement in the vertical direction and the pivoting movement with respect to a predetermined point. To this end, the mounting frame 210 is formed with the operating route guide hole 211 and the second guide hole 216. Further, the second pivot joint 234 of the link assembly 230 is arranged to be inserted in the operating route guide hole 211, and the actuating link 235 is provided with the support guide pin 237 to be inserted in the second guide hole 216.

When the driving assembly 250 with such an employed and applied structure transmits the rotatory force to the moving link 231, the connection link 233 moves while pivoting together with the second end of the moving link 231, and the second pivot joint 234 coupled to the second end moves while being guided along the operating route guide hole 211. The actuating link 235 also moves while pivoting together with the second end of the connection link 233, and the support guide pin 237 moves while being guided along the second guide hole 216.

The operating route guide hole 211 is formed to guide and move the second pivot joint 234 by the force transmitted to the connection link 233, thereby guiding the movement modes (the vertical lifting movement mode, the pivoting movement mode, and the lifting and pivoting combination movement mode) of the movable seat 110 and determining order of each movement mode.

Further, the second guide hole 216 is formed to guide and move the support guide pin 237 provided in the actuating link 235 by the force transmitted to the actuating link 235, and thus guides and supports the support guide pin 237, thereby performing an assisting operation so that the movable seat 110 can operate in the corresponding movement mode while the second pivot joint 234 moves along the operating route guide hole 211.

The movable seat 110 according to the disclosure operates to have the lifting movement and the pivoting movement by the link assembly 230, i.e. to have three types of movement modes such as the lifting movement, the pivoting movement, and the lifting and pivoting combination movement.

The operation of aiding a toilet user in standing up may be performed in order of the lifting movement mode, the lifting and pivoting combination movement mode, and the pivoting movement mode among three types of movement modes.

To aid the toilet user, who is sitting on the movable seat 110, in comfortably and safely standing up, the movable seat 110 operates to have three types of movement modes. The movable seat 110 may first operate in the lifting movement mode, then operate the lifting and pivoting combination movement mode where the vertical lifting movement and the pivoting movement are made at a time, and last operate in the pivoting movement mode.

For such operations of the movable seat 110, the operating route guide hole 211 includes a lifting guide hole 212, a lifting and pivoting guide hole 213, and a pivoting guide hole 214 which are continuously formed to communicate with each other, and formed from bottom to top in order of the lifting guide hole 212, the lifting and pivoting guide hole 213, and the pivoting guide hole 214.

The lifting guide hole 212 is formed in a vertical direction, the lifting and pivoting guide hole 213 is formed from a point of contact with the lifting guide hole 212 in an oblique direction, and the pivoting guide hole 214 is formed from a point of contact with the lifting and pivoting guide hole 213 in an upward direction while having an arc shape (or a round shape).

When the second pivot joint 234 moves being guided along the operating route guide hole 211 formed as above, the actuating link 235 pivotably connected to the second pivot joint 234 operates. To make the movable seat 110 connected to the second end of the actuating link 235 have the foregoing movement modes, the support guide pin 237 has to be guided and supported by the second guide hole 216.

To this end, the second guide hole 216, in which the support guide pin 237 is inserted and guided, is vertically formed in an upper portion of the operating route guide hole 211. Therefore, the support guide pin 237 moves as guided and supported in a vertical direction along the second guide hole 216 formed in the vertical direction.

In a state that the second pivot joint 234 for pivotable connection between the connection link 233 and the actuating link 235 is arranged to be inserted in the operating route guide hole 211 formed as above, and the support guide pin 237 formed in the actuating link 235 is arranged to be inserted in the second guide hole 216, when the rotatory force from the driving assembly 250 is transmitted to the connection link 233 via the moving link 231, the second pivot joint 234 and the support guide pin 237 are moved as guided along the operating route guide hole 211 and the second guide hole 216, respectively. Through this process, the movable seat 110 connected to the actuating link 235 operates having the foregoing movement modes in sequence as described above.

To make this operation possible, a distance between the top end of the second guide hole 216 and a contact point where the lifting and pivoting guide hole 213 and the pivoting guide hole 214 join forming the operating route guide hole 211 (i.e. a distance from the top end of the second guide hole 216 to the contact point between the lifting and pivoting guide hole 213 and the pivoting guide hole 214) may be equal to a distance between the support guide pin 237 and the second pivot joint 234 (i.e. a distance from the support guide pin 237 to the second pivot joint 234).

When such a distance condition is satisfied, the support guide pin 237 can vertically move up along the second guide hole 216 while the second pivot joint 234 obliquely moves along the lifting and pivoting guide hole 213. This operation causes the movable seat 110 connected to the actuating link 235 to have the lifting and pivoting movement where both the vertical lifting movement and the pivoting movement are produced at a time.

Further, when the second pivot joint 234 reaches the point where the lifting and pivoting guide hole 213 and the pivoting guide hole 214 join, the support guide pin 237 becomes supported on atop end portion of the second guide hole 216. Therefore, the support guide pin 237 is continuously kept supported on the top end portion of the second guide hole 216 while the second pivot joint 234 moves along the pivoting guide hole 214 in an arc direction. This operation causes the movable seat 110 connected to the actuating link 235 to have the pivoting movement with respect to the support guide pin 237 (or the top end portion of the second guide hole 216).

The pivoting guide hole 214 is formed so that the second pivot joint 234 is guided to move in a state that the support guide pin 237 is stationarily supported on the top end portion of the second guide hole 216. Therefore, the pivoting guide hole 214 is formed along an arc of a circle that centers on the support guide pin 237 (or the top end portion of the second guide hole 216) with a radius corresponding to a distance between the support guide pin 237 and the second pivot joint 234.

Meanwhile, the moving link 231 and the connection link 233 are pivotably connected by the first pivot joint 232. The moving link 231 receives the rotary force from the driving assembly 250 and transmits the rotary force to the connection link 233, so that the second pivot joint 234 can move along the operating route guide hole 211. To this end, the moving link 231 and the connection link 233 are connected by the first pivot joint 232 and pivotable with each other.

Since the first end of the moving link 231 pivotably connected by the first pivot joint 232 is connected to the pivoting shaft 258 of the worm wheel 257, and the second end of the connection link is connected to the actuating link 235 by the second pivot joint 234 moving along the operating route guide hole 211, the link assembly 230 operates well without a separate guide hole for guiding the first pivot joint 232. Nevertheless, the first pivot joint 232 may also be inserted in and guided by the first guide hole 215 formed in the mounting frame 210 in order to reduce stress on the links and make smooth motion and operation. The first guide hole 215 is formed along an arc of a circle that centers on the pivoting shaft 258 with a radius corresponding to a distance between the pivoting shaft 258 and the first pivot joint 232.

The link assembly 230 described as above receives the driving force by the driving assembly 250. In other words, the driving assembly 250 is mounted to the mounting frame 210 and transmits the driving force to the first end of the link assembly 230. Specifically, the driving assembly 250 transmits the rotatory force to the moving link 231 of the link assembly 230.

The driving assembly 250 may be configured to transmit not a force for translation motion at a lower portion of the link assembly 230, but the rotary force at the lateral portion of the link assembly 230. Further, the driving assembly 250 may be configured to occupy the minimum installation space and have a simple and easy installation structure.

To this end, the driving assembly 250 according to the disclosure includes a driving motor 251 stably and firmly mounted to the mounting frame 210, a shaft 253 connected to the shaft of the driving motor 251, a worm 255 formed on the outer circumference of the shaft 253, and a worm wheel 257 mounted to the mounting frame 210 and rotatable engaging with the worm 255. Since the driving assembly 250 according to the disclosure is configured using a worm gear assembly, the driving assembly 250 is mountable to the mounting frame 210 shaped like a plate, occupies the minimum installation space, and uses a simple structure for transmitting the rotatory force to the moving link 231.

In short, the operations of the driving assembly 250 with the foregoing configuration are as follows. When the driving motor 251 operates, the shaft 253 rotates and thus the worm 255 also rotates, thereby rotating the worm wheel 257 engaging with the worm 255. The worm wheel 257 is formed as a gear shaped like a thin disk and mounted to the mounting frame 210 to thereby rotate along with the pivoting shaft 258. Because the first end of the moving link 231 is linked to the pivoting shaft 258, the moving link 231 pivots along with the rotation of the worm wheel 257 and thus transmits a force to the connection link 233 pivotably connected to the moving link 231.

In accordance with the operations of the seat actuator 200 described as above, the operations of the movable seat 110 will be briefly described below. FIGS. 9 to 13 are schematic lateral views for explaining operations of an apparatus 300 for aiding a toilet user in standing up according to an embodiment of the disclosure.

Figure 9:
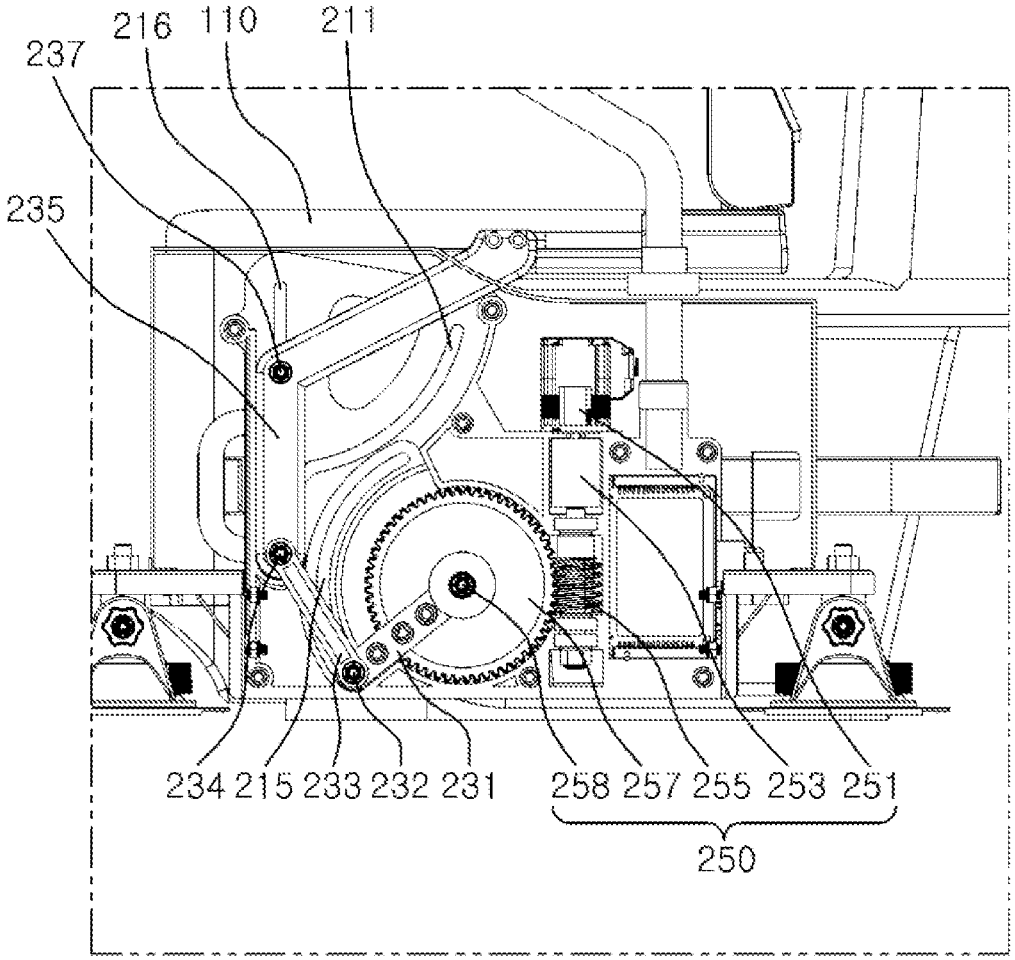
FIGS. 9 to 13 are schematic lateral views for explaining operations of an apparatus for aiding a toilet user in standing up according to an embodiment of the disclosure.

FIG. 9 shows a usual state of the apparatus 300 for aiding a toilet user in standing up according to the disclosure. In this state, the movable seat 110 is kept put on the rim of the toilet 150, so that the toilet user can directly sit on the movable seat 110 or indirectly sit on the movable seat 110 via another intermediate seat to relieve nature. According to the disclosure, the movable seat on which the toilet user can sit has not only a structure for allowing a user to directly sit but also a structure for allowing a user to indirectly sit using another intermediate seat or the like.

Figure 10:
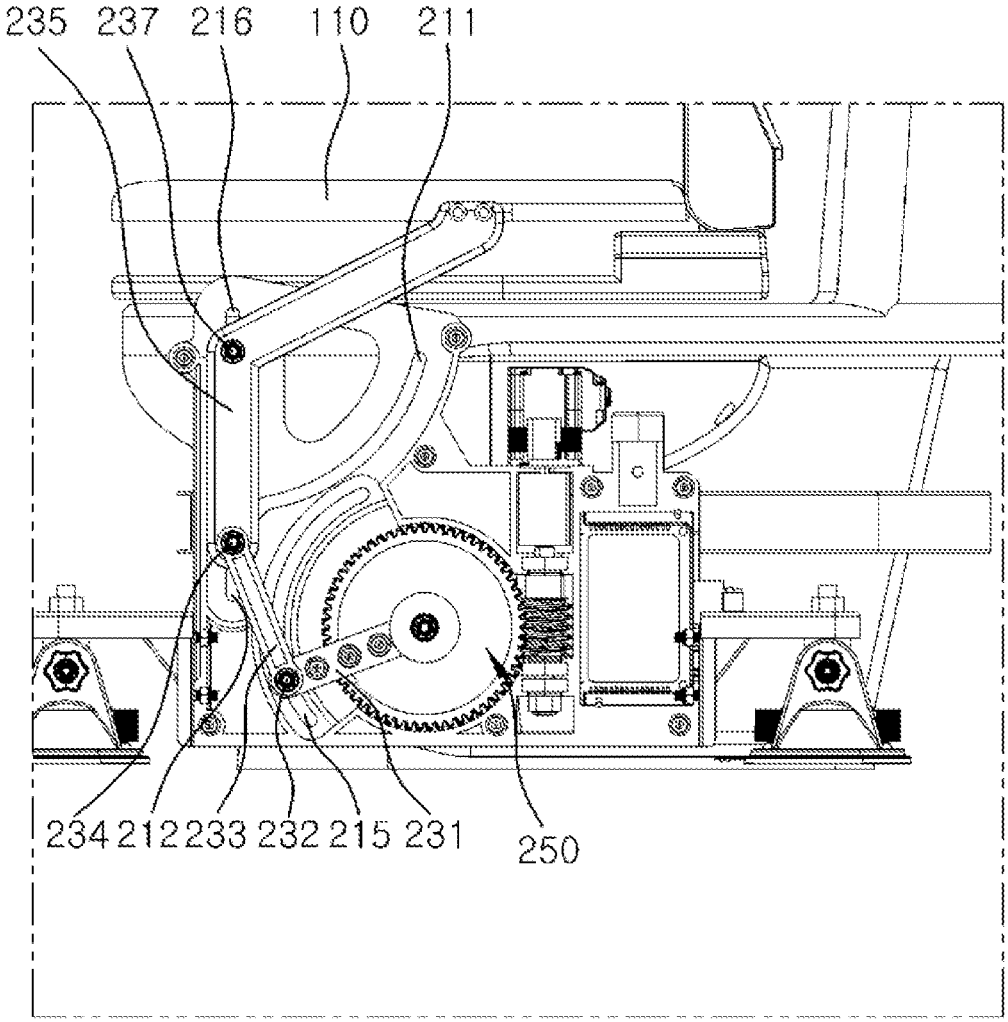

In this state, when a toilet user pushes an operation button to receive assistance in standing up, the driving assembly 250 operates to transmit the rotatory force to the moving link 231. Then, as shown in FIG. 10, the connection link 233 moves, the second pivot joint 234 moves being guided along the lifting guide hole 212 of the operating route guide hole 211, and the support guide pin 237 also moves being guided along the second guide hole 216. Thus, the movable seat 110 connected to the actuating link 235 operates having the lifting movement to be lifted up from the previous state. When the movable seat 110 operates in three types of movement modes, the actuating link 235 may be made in various forms. In other words, the actuating link 235 may be rectilinearly formed, or may be curvedly formed as shown in the disclosure. The disclosure illustrates an example that the actuating link is curvedly formed to connect its second end to the lateral rear portion of the movable seat.

Figure 11:
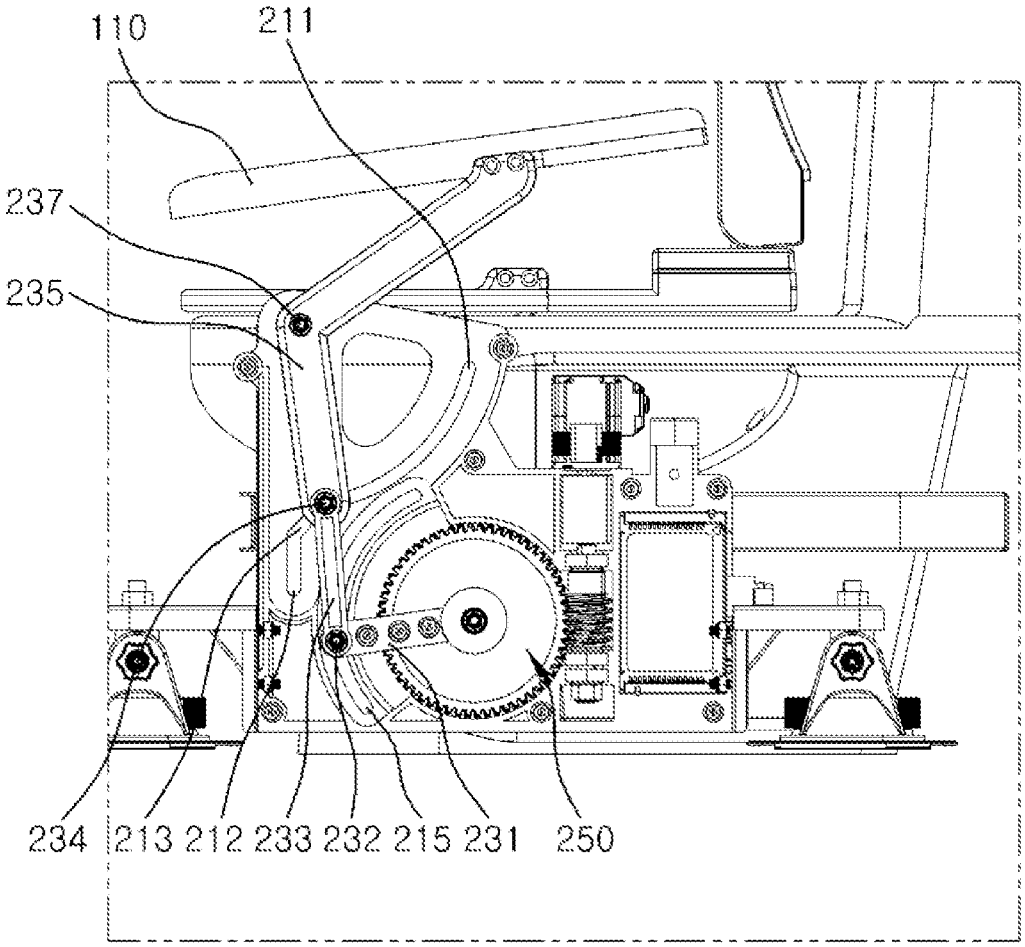

When the driving assembly 250 further drives the link assembly 230 from the state of FIG. 10, as shown in FIG. 11 the connection link 233 moves, the second pivot joint 234 moves being guided along the lifting and pivoting guide hole 213 of the operating route guide hole 211, and the support guide pin 237 also moves being guided along the second guide hole 216. Thus, the movable seat 110 connected to the actuating link 235 operates having the lifting and pivoting movement to which both the operation of rising from the previous state and the pivoting operation are applied.

Figure 12:
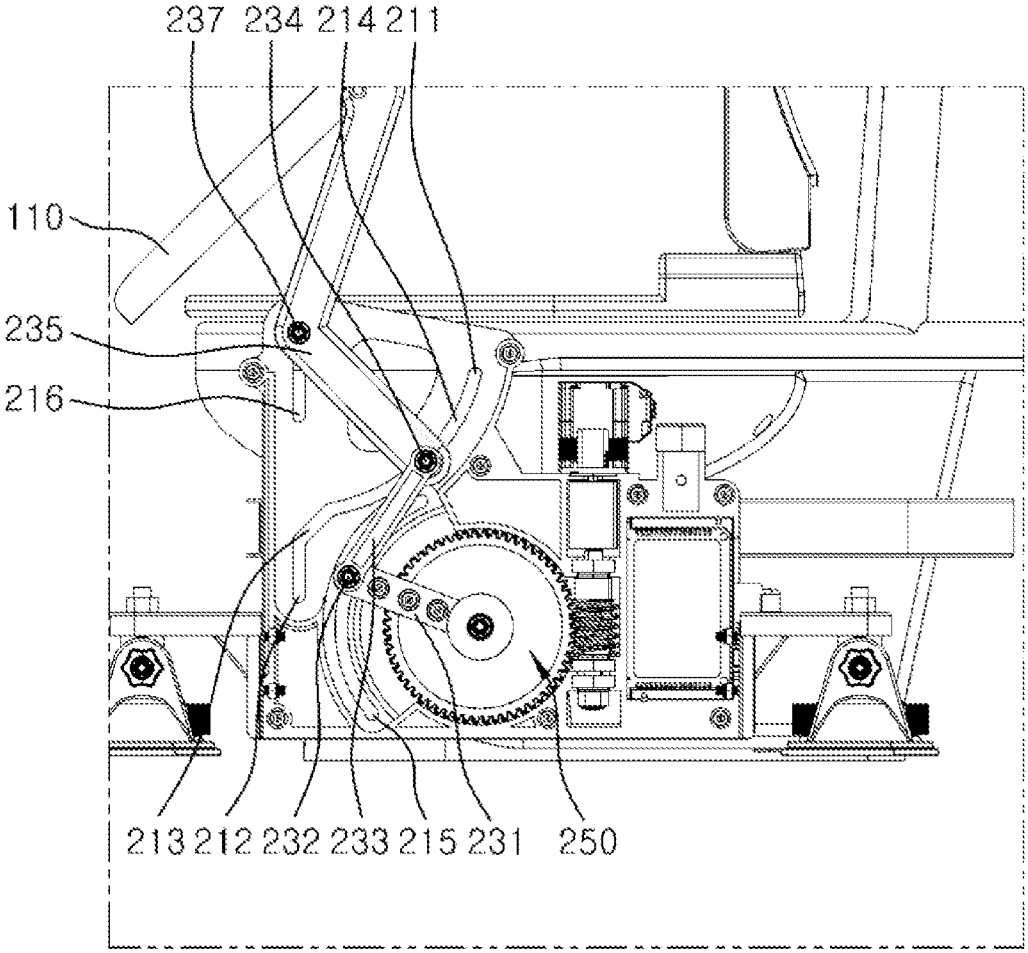
Figure 13:
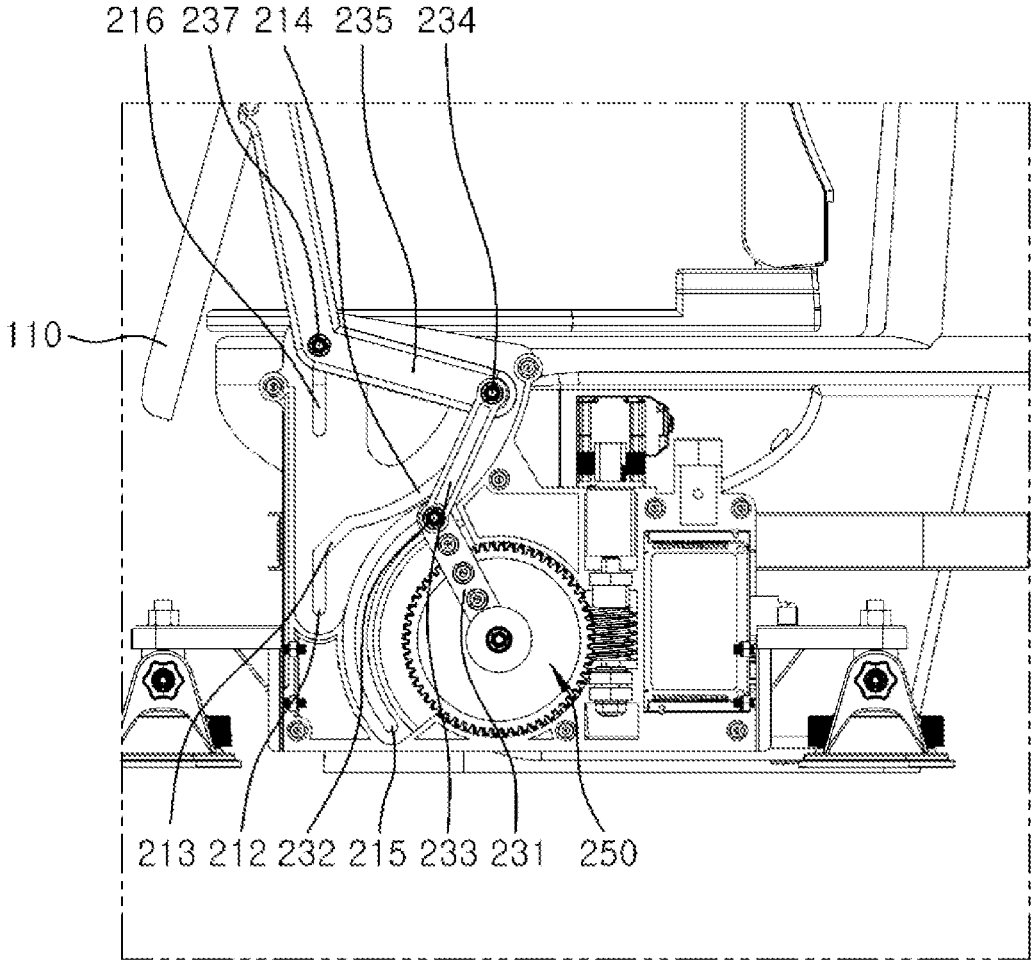

When the driving assembly 250 further drives the link assembly 230 from the state of FIG. 11, as shown in FIG. 12 the connection link 233 moves, the second pivot joint 234 moves being guided along the pivoting guide hole 214 of the operating route guide hole 211, and the support guide pin 237 is stationarily kept supported on the top end portion of the second guide hole 216 without moving. Thus, the movable seat 110 connected to the actuating link 235 operates having the pivoting movement to which the operation of pivoting on the top end portion of the second guide hole 216 from the previous state is applied. The pivoting movement may proceed up to the state shown in FIG. 13.

By such operations of the apparatus 300 for aiding a toilet user in standing up according to the disclosure, the toilet user can comfortably and easily stand up. Then, when a user presses a return button or at the state of FIG. 13, the apparatus 300 for aiding a toilet user in standing up according to the disclosure performs the foregoing operations in reverse order, and thus the movable seat 110 returns to an initial position.

The seat actuator 200 as described above needs to be stably and firmly mounted to the lateral portion of the toilet 150, and may be easily changeable in installation position and adjustable in level as necessary.

To this end, the mounting frame 210 is kept mounted to and supported on the support/suction module 270 with the support bracket 260 interposed between the mounting frame 210 and the support/suction module 270, and the support/suction module 270 is stuck on to a floor (e.g. a bathroom floor where the toilet 150 is installed) by a suction force.

The support bracket 260 is firmly coupled to lower portions of at both edges of the mounting frame 210. The support bracket 260 is height-adjustably fastened to the mounting frame 210. Like this, the support bracket 260 fastened to the mounting frame 210 is coupled to the support/suction module 270 stuck to the floor by the suction force. The support bracket 260 may be also height-adjustably coupled to the support/suction module 270. Since the mounting frame 210 is height-adjustably mounted to the support/suction module 270 by means of the support bracket 260, level control is easy. Further, the mounting frame 210 is mounted to the support/suction module 270 stuck to the floor by the suction force, and therefore it is easy to change the position of the seat actuator 200 or the apparatus 300 for aiding a toilet user in standing up according to the disclosure.

Meanwhile, according to the disclosure, the mounting frame 210 mounted with the link assembly 230 and the driving assembly 250 is installed at a lateral side of the toilet 150 and kept covered with the case 290 for beauty and protection. The case 290 may be readily detachably coupled to the mounting frame 210.

It does not matter if the foregoing seat actuator 200 may be installed at only one side of two lateral sides of the toilet 150 and actuate the movement of the movable seat 110. In other words, the seat actuator 200 may be adjacent to only one lateral portion of the toilet 150 as connected to only one side of the movable seat 110 and make the moveable seat 110 move.

To facilitate the operations of the movable seat 110 and make the movable seat 110 move more stably, the seat actuator 200 according to the disclosure may be installed at each side of the both lateral portions of the toilet 150 and actuate the movement of the movable seat 110 as connected to both lateral sides of the movable seat 110. Of course, the seat actuators 200 respectively installed at both lateral portions of the toilet 150 are synchronized. In other words, the driving assemblies and the link assemblies have the same configuration, and the driving operations of the driving motor are synchronized.

When the seat actuators 200 are arranged at both lateral portions of the toilet, they have to be connected to each other and maintain a stable posture. To this end, the apparatus 300 for aiding a toilet user in standing up according to the disclosure may further include a front connection frame 281 for connecting the front portions of one pair of seat actuators 200 respectively arranged at both lateral portions of the toilet 150, and a rear connection frame 283 for connecting the rear portions.

Meanwhile, one pair of seat actuators 200 may be rearranged by adjusting their arranged positions or a separation distance between them. To this end, the front connection frame 281 and the rear connection frame 283 are length-adjustably formed. Therefore, one pair of seat actuators 200 may be changed in the separation distance or the mounting position by adjusting the length of the front connection frame 281 and the length of the rear connection frame 283.

Accordingly, the actuating link 235 and the movable seat 110 may be connected to have an adjustable length. To this end, the second end of the actuating link 235 is connected to the lateral portion of the movable seat 110 with an adjustable length or a changeable connection position. Of course, the second end of the actuating link 235 may have a connection structure to be stably and firmly kept while being connected to the movable seat 110.

Meanwhile, the foregoing apparatus 300 for aiding a toilet user in standing up according to the disclosure aids the toilet user in easily and safely standing up by supporting his/her hips, and a mobility-assistance safety bar 100 may be further provided to more smoothly and strongly assist the toilet user in standing up. In other words, that the apparatus 300 for aiding a toilet user in standing up according to the disclosure may additionally include the mobility-assistance safety bar 100.

The mobility-assistance safety bar 100 according to the disclosure may be arranged adjacent to the toilet 150, and attached to only a floor or installed throughout the floor and a wall or throughout the floor and the seat actuator 200.

Thus, the mobility-assistance safety bar according to the disclosure includes a first connection bar 30, a second connection bar 40 angle-adjustably connected to the first connection bar 30, a connection module 50 connecting the first end of the first connection bar 30 and the first end of the second connection bar 40 and allowing an angle between the first connection bar 30 and the second connection bar 40 to be adjustable, and a pair of coupling/suction modules 10 coupled to at least one second end of the first connection bar 30 and the second connection bar 40, adjustable in angle with regard to the connection bar for coupling (e.g. the first connection bar 30 in the disclosure), and stuck to a target surface by a suction force.

One pair of connection bars, i.e. the first connection bar 30 and the second connection bar 40 are connected to be adjustable in angle between them. To this end, the connection module 50 is used to connect one pair of connection bars 30 and 40 between which an angle is adjustable. Further, the coupling/suction module 10 is angle-adjustably coupled to the corresponding first connection bar 30 and attached to the target surface by the suction force.

One pair of connection bars 30 and 40 is shaped like pipes, of which the first ends are connected to the connection module 50, and the second ends may be coupled to the coupling/suction module 10 or one of two second ends may be coupled to the coupling/suction module 10 and the other one may be coupled to the seat actuator 200.

However, the mobility-assistance safety bar 100 according to the disclosure may include one side mounted to the floor and the other side mounted to the seat actuator 200 because the mobility-assistance safety bar 100 is employed for aiding the toilet user in the mobility and the seat actuator 200 is stably and firmly mounted adjacent to the toilet.

Specifically, the second end of the first connection bar 30 of one pair of connection bars 30 and 40 may couple with the coupling/suction module 10, and the second end of the second connection bar 40 couples with a connection bar mounting portion 218 formed in the mounting frame 210 of the seat actuator 200.

Therefore, the first connection bar 30 has a structure, one side and the other side of which are respectively connected or coupled to the connection module 50 and the coupling/suction module 10. The second connection bar 40 has a structure, one side and the other side of which are respectively connected or mounted to the connection module 50 and the connection bar mounting portion 218 formed in the mounting frame 210.

In the apparatus for aiding a toilet user in standing up according to the disclosure with the foregoing objects and solutions, a movable seat on which the toilet user sits is automatically movable having at least one of lifting movement and pivoting movement, thereby having an effect on assisting the toilet user in easily and safely standing up.

Further, according to the disclosure, the link assembly is configured to make the movable seat have the lifting movement, the lifting and pivoting movement, and the pivoting movement in sequence, thereby assisting the toilet user in comfortably standing up and having an advantage of minimizing possibility of unexpected accidents during a standing-up procedure.

Although a few exemplary embodiments of the disclosure have been shown and described, these are for illustrative purpose only and it will be appreciated by those skilled in the art that changes may be made in these embodiments without departing from the principles and spirit of the invention, the scope of which is defined in the appended claims and their equivalents.

What is claimed is:

1. An apparatus for aiding a user of a toilet in standing up, comprising:

a movable seat movably mounted to the toilet;

a seat actuator arranged adjacent to the toilet and actuating the movable seat to move having at least one of lifting movement and pivoting movement; and a mobility-assistance safety bar arranged adjacent to the toilet, wherein the seat actuator comprises:

a mounting frame adjacent to and stationarily mounted to the toilet;

a link assembly movably mounted to the mounting frame and comprising at least two links which receive a driving force through a first end and produce the lifting movement and the pivoting movement of the movable seat connected to a second end; and a driving assembly mounted to the mounting frame and transmitting the driving force to the first end of the link assembly, wherein the mounting frame comprises:

an operating route guide hole having a certain path for determining and guiding the movement mode of the movable seat;

a first guide hole configured to guide movement of a first pivot joint of the link assembly; and a second guide hole configured to guide movement of a support guide pin of the link assembly, wherein the link assembly comprises a moving link, a connection link, and an actuating link, wherein the moving link and the connection link are pivotably connected by the first pivot joint, the connection link and the actuating link are pivotably connected by a second pivot joint, the second pivot joint is arranged to be inserted in the operating route guide hole, and the actuating link is provided with the support guide pin arranged to be inserted in the second guide hole, and wherein the mobility-assistance safety bar comprises:

a first connection bar;

a second connection bar angle-adjustably connected to the first connection bar;

a connection module connecting a first end of the first connection bar and a first end of the second connection bar so that an angle between the first connection bar and the second connection bar is adjustable; and a pair of coupling/suction modules coupled to a second end of at least one of the first connection bar and the second connection bar, adjustable in angle with respect to the coupled connection bar, and stuck to a target surface by a suction force.

* * * * *